United States Patent [19]

Whipple

[11] Patent Number: 4,643,140

[45] Date of Patent: Feb. 17, 1987

[54] TWO-CYCLE ENGINE EXHAUST PORT

[75] Inventor: Roger B. Whipple, Waukegan, Ill.

[73] Assignee: Outboard Marine Corporation, Waukegan, Ill.

[21] Appl. No.: 742,768

[22] Filed: Jun. 10, 1985

[51] Int. Cl.[4] ..... F02B 75/02

[52] U.S. Cl. ..... 123/65 PE; 123/65 P

[58] Field of Search ..... 123/65 PE, 65 P, 61 R, 123/65 R, 668, 193 C, 41.83, 41.84

[56] References Cited

U.S. PATENT DOCUMENTS

| | | | |
|---|---|---|---|
| 1,263,820 | 4/1918 | Tidman . | |
| 1,520,620 | 12/1924 | Wall | 123/65 A |
| 1,622,717 | 3/1927 | Hilderbrand | 123/65 A |
| 1,839,576 | 1/1932 | Mohr et al. | 123/65 R |
| 1,952,275 | 3/1934 | Mohr | 123/65 R |
| 3,379,179 | 4/1968 | Mantzel | 123/65 |
| 3,945,354 | 3/1976 | Johnston | 123/65 P |
| 4,016,850 | 4/1977 | Bloemers | 123/193 C |
| 4,121,552 | 10/1978 | Mithuo et al. | 123/65 A |
| 4,202,297 | 5/1980 | Oku et al. | 123/65 A |
| 4,233,717 | 11/1980 | Noda et al. | 123/65 A |
| 4,337,734 | 7/1982 | Iio | 123/65 P |
| 4,362,132 | 12/1982 | Neuman | 123/65 P |
| 4,458,636 | 7/1984 | Kania | 123/73 R |

FOREIGN PATENT DOCUMENTS

| | | | |
|---|---|---|---|
| 2839404 | 3/1979 | Fed. Rep. of Germany | 123/65 P |
| 56-518 | 1/1981 | Japan . | |
| 349423 | 5/1931 | United Kingdom | 123/65 P |

*Primary Examiner*—Willis R. Wolfe, Jr.
*Assistant Examiner*—David A. Okonsky
*Attorney, Agent, or Firm*—Michael, Best & Friedrich

[57] ABSTRACT

A cylinder liner comprising a generally cylindrical outer wall, a generally cylindrical inner wall defining a cylinder having a bottom end, and an exhaust port communicating with the cylinder and being defined by an upper wall extending between the inner and outer walls and being curved concavely with respect to the bottom end, a lower wall extending between the inner and outer walls and being curved convexly with respect to the bottom end, and opposite side walls extending between the inner and outer walls and between the upper and lower walls and converging toward the bottom end of the cylinder.

19 Claims, 4 Drawing Figures

TWO-CYCLE ENGINE EXHAUST PORT

BACKGROUND OF THE INVENTION

The invention relates to internal combustion engines, and more particularly to exhaust ports in two-cycle internal combustion engines.

Attention is directed to the following U.S. patents which disclose various exhaust port geometries: Noda U.S. Pat. No. 4,233,717, issued Nov. 18, 1980; Kania U.S. Pat. No. 4,458,636, issued July 10, 1984; Iio U.S. Pat. No. 4,337,734, issued July 6, 1982; Oku U.S. Pat. No. 4,202,297, issued May 13, 1980; Mithuo U.S. Pat. No. 4,121,552, issued Oct. 24, 1978; Jonnston U.S. Pat. No. 3,945,354, issued Mar. 23, 1976; Mohr U.S. Pat. No. 1,952,275, issued Mar. 27, 1934; Mohr U.S. Pat. No. 1,839,576, issued Jan. 5, 1932; Hildebrand U.S. Pat. No. 1,622,717, issued Mar. 29, 1927; and Wall U.S. Pat. No. 1,520,620, issued Dec. 23, 1924.

Attention is also directed to the following foreign patents which disclose exhaust port geometries: German Pat. No. 2,839,404; Japanese Pat. No. 56-518; and British Pat. No. 349,423.

SUMMARY OF THE INVENTION

The invention provides a cylinder liner comprising a generally cylindrical outer wall, a generally cylindrical inner wall defining a cylinder having a bottom end, and an exhaust port communicating with the cylinder and defined by an upper wall extending between the inner and outer walls and being curved concavely with respect to the bottom end, a lower wall extending between the inner and outer walls and being curved convexly with respect to the bottom end, and opposite side walls extending between the inner and outer walls and between the upper and lower walls and converging toward the bottom end of the cylinder.

In one embodiment, the upper wall has a bevelled radially inner edge, and the lower wall has a bevelled radially inner edge.

In one embodiment, the upper wall inner edge is bevelled at an angle of approximately 45° with respect to the inner wall, and the lower wall inner edge is bevelled at an angle of approximately 30° with respect to the inner wall.

In one embodiment, the cylinder has a longitudinal axis, and eacn of the side walls forms an angle of approximately 10° with a line parallel to the longitudinal axis.

In one embodiment, each of the side walls meets the upper wall to form a curved corner.

In one embodiment, each of the side walls meets the lower wall to form a curved corner.

In one embodiment, the cylinder has a diameter, the upper wall has a radius of curvature approximately equal to twice the diameter, and the lower wall has a radius of curvature approximately equal to the diameter.

In one embodiment, the cylinder has a length approximately equal to twice the diameter.

The invention also provides a cylinder liner comprising a generally cylindrical outer wall, a generally cylindrical inner wall defining a cylinder having a bottom end, and an exhaust port communicating with the cylinder and defined by an upper wall extending between the inner and outer walls and having a radially inner edge bevelled at an angle of approximately 45° with respect to the inner wall, a lower wall extending between the inner and outer walls and having a radially inner edge bevelled at an angle of approximately 30° with respect to the inner wall, and opposite side walls extending between the inner and outer walls and between the upper and lower walls and converging toward the bottom end of the cylinder.

The invention also provides an internal combustion engine comprising an inner wall defining a cylinder having a bottom end and a longitudinal axis, and an exhaust port communicating with the cylinder and defined by an upper wall curved concavely with respect to the bottom end and having a portion extending generally perpendicularly to the inner wall, and a radially inner edge bevelled at an angle of approximately 45° with respect to the inner wall, a lower wall curved convexly with respect to the bottom end and having a portion extending generally perpendicularly to the inner wall, and a radially inner edge bevelled at an angle of approximately 30° with respect to the inner wall, and opposite side walls extending generally perpendicularly to the inner wall between the upper and lower walls, the side walls converging toward the bottom end of the cylinder and each forming an angle of approximately 10° with a line parallel to the longitudinal axis.

A principal feature of the invention is the provision of a cylinder liner comprising an inner wall defining a cylinder having a bottom end and a longitudinal axis, and an exhaust port defined by an upper wall curved concavely with respect to the bottom end and having a radially inner surface or edge bevelled at an angle of approximately 45° with respect to the inner wall, a lower wall curved convexly with respect to the bottom end and having a radially inner surface or edge bevelled at an angle of approximately 30° with respect to the inner wall, and opposite side walls converging toward the bottom end of the cylinder and each forming an angle of approximately 10° with a line parallel to the longitudinal axis. This exhaust port geometry maximizes blow-down without over-scavenging, prolongs piston ring life, maximizes engine horsepower, and reduces engine noise.

Other principal features and advantages of the invention are set forth in the following detailed description, claims, and drawings.

Figure 1:
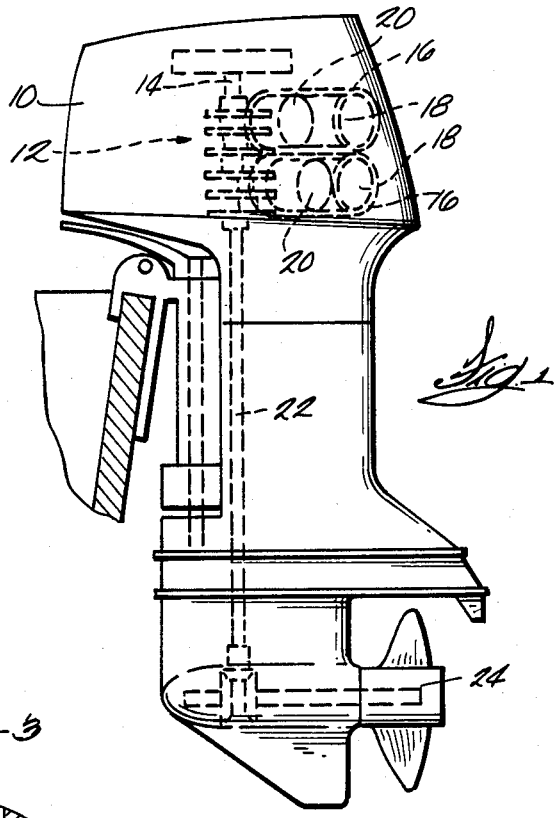
FIG. 1 is a side elevational view of an outboard motor including an internal combustion engine embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is an outboard motor 10 including a two-cycle internal combustion engine 12 embodying the invention. The engine 12 is shown schematically and comprises a crankshaft 14, a pair of cylinder liners 16 defining a pair of cylinders 18, and a pair of pistons 20 reciprocally movable in respective cylinders 18. The pistons 20 are connected to the crankshaft 14 by piston rods (not shown), as is known in the art. The outboard motor 10 also includes a conventional drive train 22 connected between the crankshaft 14 and a propeller 24.

The cylinder liners 16 are substantially identical, and only one will be described in detail. The dimensions of the cylinder liner 16 will be described in order to provide an example of suitable dimensions, but it should be understood that other dimensions are within the scope of the invention, and that the preferred dimensions will vary depending on flow considerations and the required volume of the cylinder.

Figure 2:
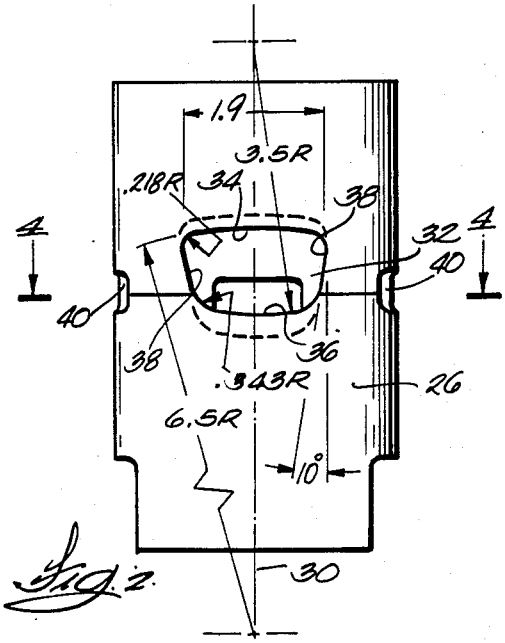
FIG. 2 is a side elevational view of a cylinder liner of the internal combustion engine.

As best shown in FIGS. 2 througn 4, the cylinder liner 16 comprises a generally cylindrical outer wall 26, and a generally cylindrical inner wall 28 defining the cylinder 18 which has top and bottom ends (as viewed in FIGS. 2 and 3) and a longitudinal axis 30. The cylinder liner 16 also comprises an exhaust port 32 communicating with the cylinder 18 and being defined by an upper wall 34 extending between and generally perpendicularly to the inner and outer walls 28 and 26, a lower wall 36 extending between and generally perpendicularly to the inner and outer walls 28 and 26, and opposite side walls 38 extending between and generally perpendicularly to the inner and outer walls 28 and 26 and between the upper and lower walls 34 and 36.

It should be understood that while in the preferred embodiment the cylinder 18 is defined by the inner wall 28 of the cylinder liner 16, in alternative embodiments the cylinder 18 can be defined by any generally cylindrical inner wall of the internal combustion engine 12.

The cylinder liner 16 is preferably designed for a loop scavenged cylinder with a boost port. Therefore, the cylinder liner 16 also comprises a pair of generally diametrically opposite transfer ports 40, and a boost port 42 located generally diametrically opposite the exhaust port 32. This construction is known in the art and need not be described in greater detail.

Figure 3:
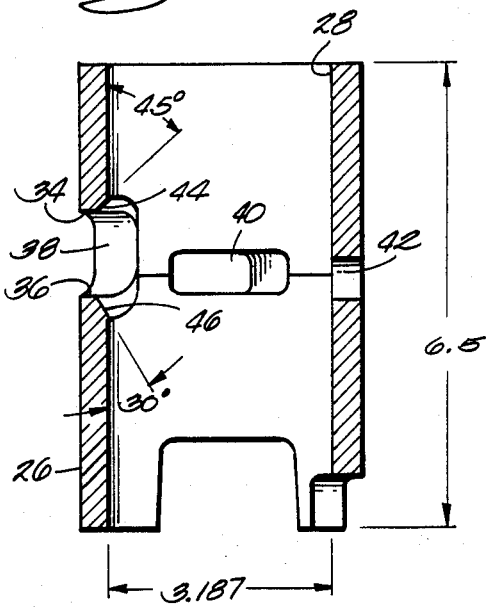
FIG. 3 is a cross-sectional view taken along line 3—3 in FIG. 4.

In the preferred embodiment, the cylinder 18 has a diameter (the inside diameter of the inner wall 28) of approximately 3 3/16" or 3.187" (see FIG. 3). Also, the cylinder 18 has a length between the top and bottom ends approximately equal to 6.5", or approximately twice the diameter.

Preferably, the upper wall 34 of the exhaust port 32 is curved concavely with respect to the bottom end, as best shown in FIG. 2, and the radius of curvature of the upper wall 34 is approximately equal to 6.5", or approximately twice the diameter of the cylinder 18. Also, the lower wall 36 of the exhaust port 32 is curved convexly with respect to the bottom end, and the radius of curvature of the lower wall 36 is approximately equal to 3.5", or approximately the diameter of the cylinder 18.

The curved upper and lower walls 34 and 36 both reduce engine noise and prolong piston ring life by causing the piston ring (not shown) to more gradually expand into and contract from the exhaust port 32. This expansion and contraction becomes more gradual as the radius of curvature of the exhaust port upper and lower walls is decreased. Thus, the 3.5" radius of curvature of the lower wall 36 is more effective than the 6.5" radius of curvature of the upper wall 34 in reducing engine noise and prolonging piston ring life. However, the upper wall 34 has a greater radius of curvature in order to maximize blow-down (the escape of gases from the cylinder 18 through the exhaust port 32 between the time of exhaust port opening and the time of transfer port opening) by maximizing the area of the upper portion of the exhaust port 32.

Figure 4:
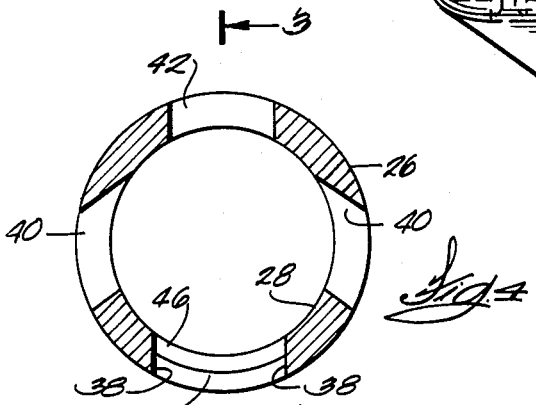
FIG. 4 is a cross-sectional view taken along line 4—4 in FIG. 2.

In the preferred embodiment, the upper wall 34 has a radially inner surface or edge 44 (FIG. 3) that is preferably bevelled at an angle of approximately 45° with respect to the inner wall 28. Also, the lower wall 36 has a radially inner surface or edge 46 (FIGS. 3 and 4) that is preferably bevelled at an angle of approximately 30° with respect to the inner wall 28. The bevelling of the upper wall inner edge 44 serves two purposes. First, it decreases turbulance or swirling of gases flowing out of the exhaust port 32, thereby improving engine performance. Second, like the concave curvature of the upper wall 34, it causes a more gradual expansion and contraction of the piston ring at the exhaust port 32. It has been found that a bevel of approximately 45° is optimal for achieving these two purposes. On the other hand, the bevel of the lower wall inner edge 46 has only one main purpose, that being to cause a more gradual expansion and contraction of the piston ring at the exhaust port 32. It has been found that a bevel of approximately 30° is optimal for achieving this purpose.

In the preferred embodiment, the side walls 38 converge toward the bottom end of the cylinder 18 and each forms an angle of approximately 10° with a line parallel to the longitudinal axis 30 of the cylinder 18. In the preferred embodiment, the exhaust port 32 has an upper width of approximately 1.9" (see FIG. 2). Like the curved upper and lower walls 34 and 36 and the bevelled inner edges 44 and 46, the converging side walls 38 also serve to cause more gradual expansion and contraction of the piston ring. At the same time, the wider upper portion of the exhaust port 32 maximizes blow-down by maximizing the area of the upper portion of the exhaust port 32.

As best shown in FIG. 2, each of the side walls 38 preferably meets the upper wall 34 to form a curved corner, and each meets the lower wall 36 to form a curved corner. These curved corners serve to cause more gradual expansion and contraction of the piston ring, the expansion and contraction becoming more gradual as the radius of curvature of the corners is increased. However, increasing the radius of curvature of the corners also decreases the area of the exhaust port 32. Thus, in order to maximize blow-down, the corners formed by the side walls 38 and the upper wall 34 have a lesser radius of curvature than the corners formed by the side walls 38 and the lower wall 36, again to maximize the area of the upper portion of the exhaust port 32. In the preferred embodiment, as shown in FIG. 2, the upper corners have a radius of curvature of approximately 0.218", and the lower corners have a radius of curvature of approximately 0.343".

Other features and advantages of the invention are set forth in the following claims.

I claim:

1. A cylinder liner comprising a generally cylindrical outer wall, a generally cylindrical inner wall defining a cylinder having a diameter and a bottom end, and an exhaust port communicating with said cylinder and defined by an upper wall extending between said inner and outer walls and being curved concavely with respect to said bottom end, said upper wall having a radius of curvature equal to approximately twice said diameter, a lower wall extending between said inner and outer walls and being curved convexly with respect to said bottom end, said lower wall having a radius of curvature approximately equal to said diameter, and opposite side walls extending between said inner and outer walls and between said upper and lower walls.

2. A cylinder liner as set forth in claim 1 wherein said cylinder has longitudinal axis, and wherein said side walls converge toward said bottom end and each of said side walls forms an angle of approximately 10° with a line parallel to said longitudinal axis.

3. A cylinder liner as set forth in claim 1 wherein each of said side walls meets said upper wall to form respective curved corners.

4. A cylinder liner as set forth in claim 1 wherein said upper wall has an outwardly and downwardly bevelled radially inner edge, and wherein said lower wall has an outwardly and upwardly bevelled radially inner edge.

5. A cylinder liner as set forth in claim 4 wherein said upper wall inner edge is bevelled at an angle of apparoximately 45° with respect to said inner wall, and wherein said lower wall inner edge is bevelled at an angle of approximately 30° with respect to said inner wall.

6. A cylinder liner as set forth in claim 1 wherein each of said side walls meets said lower wall to form respective curved corners.

7. A cylinder liner as set forth in claim 6 wherein each of said side walls meets said upper wall to form respective curved corners having an upper radius of curvature, and wherein said corners formed by said side walls and lower wall have a lower radius of curvature equal to approximately 1.5 times said upper radius of curvature.

8. A cylinder liner comprising a generally cylindrical outer wall, a generally cylindrical inner wall defining a cylinder having a bottom end, and an exhaust port communicating with said cylinder and defined by an upper wall extending between said inner and outer walls and having a radially inner edge bevelled outwardly and downwardly from said inner wall, a lower wall extending between said inner and outer walls and having a radially inner edge bevelled outwardly and upwardly from said inner wall, and opposite side walls extending between said inner and outer walls and between said upper and lower walls and converging toward said bottom end of said cylinder.

9. A cylinder liner as set forth in claim 8 wherein said cylinder has a longitudinal axis, and wherein each of said side walls forms an angle of approximately 10° with a line parallel to said longitudinal axis.

10. A cylinder liner as set forth in claim 8 wherein each of said side walls meets said upper wall to form a respective curved corners.

11. A cylinder liner as set forth in claim 8 wherein said upper wall inner edge is bevelled at an angle of approximately 45° with respect to said inner wall, and wherein said lower wall inner edge is bevelled at an angle of approximately 30° with respect to said inner wall.

12. A cylinder liner as set forth in claim 8 wherein said upper wall is curved concavely with respect to said bottom end, and wherein said lower wall is curved convexly with respect to said bottom end.

13. A cylinder liner as set forth in claim 12 wherein said cylinder has a diameter, wherein said upper wall has a radius of curvature approximately equal to twice said diameter, and wherein said lower wall has a radius of curvature approximately equal to said diameter.

14. A cylinder liner as set forth in claim 8 wherein each of said side walls meets said lower wall to form a respective curved corners.

15. A cylinder liner as set forth in claim 14 wherein each of said side walls meets said upper wall to form respective curved corners having an upper radius of curvature, and wherein said corners formed by said side walls and lower wall have a lower radius of curvature equal to approximately 1.5 times said upper radius of curvature.

16. A cylinder liner comprising a generally cylindrical outer wall, a generally cylindrical inner wall defining a cylinder having a diameter, a bottom end and a longitudinal axis, and an exhaust port communicating with said cylinder and defined by an upper wall extending between said inner and outer walls, said upper wall having a radius of curvature equal to approximately twice said diameter and being curved concavely with respect to said bottom end, and said upper wall having a radially inner edge bevelled outwardly and downwardly at an angle of approximately 45° with respect to said inner wall, a lower wall extending between said inner and outer walls, said lower wall having a radius of curvature approximately equal to said diameter and being curved convexly with respect to said bottom end, and said lower wall having a radially inner edge bevelled outwardly and upwardly at an angle of approximately 30° with respect to said inner wall, and opposite side walls extending between said inner and outer walls and between said upper and lower walls, said side walls converging toward said bottom end of said cylinder and each forming an angle of approximately 10° with a line parallel to said longitudinal axis, each of said side walls meeting said upper wall to form respective corners having an upper radius of curvature, and each of said side walls meeting said lower wall to form respective corners having a lower radius of curvature equal to approximately 1.5 times said upper radius.

17. An internal combustion engine comprising an inner wall defining a cylinder having a diameter, a bottom end and a longitudinal axis, and an exhaust port communicating with said cylinder and defined by an upper wall having a radius of curvature equal to approximately twice said diameter and being curved concavely with respect to said bottom end, and said upper wall having a radially inner edge bevelled outwardly and downwardly at an angle of approximately 45° with respect to said inner wall, a lower wall having a radius of curvature approximately equal to said diameter and being curved convexly with respect to said bottom end, and said lower wall having a radially inner edge bevelled outwardly and upwardly at an angle of approximately 30° with respect to said inner wall, and opposite side walls extending generally perpendicularly to said inner wall between said upper and lower walls, said said walls converging toward said bottom end of said cylinder and each forming an angle of approximately 10° with a line parallel to said longitudinal axis, each of said side walls meeting said upper wall to form respective corners having an upper radius of curvature, and each of said side walls meeting said lower wall to form respective corners having a lower radius of curvature equal to approximately 1.5 times said upper radius.

18. A cylinder liner comprising a generally cylindrical outer wall, a generally cylindrical inner wall defining a cylinder, and an exhaust port communicating with said cylinder and defined by an upper wall extending between said inner and outer walls, a lower wall extending between said inner and outer walls, and opposite side walls extending between said inner and outer walls and between said upper and lower walls, each of said side walls meeting said upper wall to form respective corners having an upper radius of curvature, and each of said side walls meeting with said lower wall to form respective corners having a lower radius of curvature equal to approximately 1.5 times said upper radius.

19. A cylinder liner comprising a generally cylindrical outer wall, a generally cylindrical inner wall defining a cylinder having a bottom end, and an exhaust port communicating with said cylinder and defined by an upper wall extending between said inner and outer walls, curved concavely with respect to said bottom end, and having a radially inner edge bevelled outwardly and downwardly from said inner wall, a lower wall extending between said inner and outer walls, curved convexly with respect to said bottom end, and having a radially inner edge bevelled outwardly and upwardly from said inner wall, and opposite side walls extending between said inner and outer walls and between said upper and lower walls.

* * * * *